US006416648B1

(12) United States Patent
Park

(10) Patent No.: US 6,416,648 B1
(45) Date of Patent: Jul. 9, 2002

(54) METHOD OF MANUFACTURING STEEL SHEETS COATED WITH ZN-FE ALLOY

(75) Inventor: Hyoun Soo Park, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 76 days.

(21) Appl. No.: 09/696,015

(22) Filed: Oct. 26, 2000

(30) Foreign Application Priority Data

Oct. 30, 1999 (KR) ..... 99-47781

(51) Int. Cl.[7] ..... C25D 3/56

(52) U.S. Cl. ..... 205/155; 205/217; 205/220; 205/245

(58) Field of Search ..... 205/141, 155, 205/217, 220, 245

(56) References Cited

U.S. PATENT DOCUMENTS 3,791,801 A * 2/1974 Ariga et al. ..... 29/196.5
4,290,860 A * 9/1981 Matsudo et al. ..... 204/27
4,444,629 A * 4/1984 Martin ..... 204/432
4,578,158 A * 3/1986 Kanamaru et al. ..... 204/44.2
4,746,411 A * 5/1988 Klos et al. ..... 204/44.2

OTHER PUBLICATIONS

Abnen Brenner, Electrodeposition of Alloys, Academic Press, New York, vol. II. pp. 196, 1963.*

Frederick A. Lowenheim, Electroplating, McGraw–Hill Book Co., New York, pp. 8–9, 1978.*

* cited by examiner

*Primary Examiner*—Donald R. Valentine
*Assistant Examiner*—William T. Leader
(74) *Attorney, Agent, or Firm*—Birch, Stewart, Kolasch & Birch, LLP

(57) ABSTRACT

The present invention relates to a method to manufacture steel sheets coated with Zn—Fe alloy with an excellent corrosion resistance used in producing a body frame and a chassis of an automobile under optimal coating conditions by adjusting the temperature, pH, electric current density of an electrolyte consisting of zinc sulfate hydrate, iron sulfate hydrate, ammonium sulfate and potassium chloride as well as the thickness of a coating layer.

2 Claims, 3 Drawing Sheets

METHOD OF MANUFACTURING STEEL SHEETS COATED WITH ZN-FE ALLOY

BACKGROUND OF THE INVENTION

1. Field of the Invention

The present invention relates to a method of manufacturing steel sheets coated with Zn—Fe alloy which are used in producing a body frame and a chassis of an automobile, and more particularly to a method of manufacturing electrogalvanized steel sheets coated with Zn—Fe alloy having maximized corrosion resistance and simplified process by optimizing deposition parameters such as temperature, pH, electric current density of an electrolyte consisting of zinc sulfate hydrate, iron sulfate hydrate, ammonium sulfate and potassium chloride as well as the thickness of a coating layer.

2. Description of the Prior Art

It has been well known to use steel sheets coated with zinc alloy in body frame or chassis of automobiles due to their improved mechanical properties in molding and welding compared to those coated with pure zinc.

In manufacturing conventional steel sheets coated with Zn—Fe alloy, most of composition control has been mainly depended on the direct control by changing the composition of each electrolyte and the effect of anomalous codeposition by adjusting the electric current densities has been rarely considered. Moreover, it has been shown that loading of excessive current densities only to improve the productivity of steel sheets often resulted in both the waste in electric power and the over-consumption of iron.

SUMMARY OF THE INVENTION

An object of the present invention is to provide a method of manufacturing steel sheets coated with Zn—Fe alloy having maximized corrosion resistance and simplified process so as to be used in producing body frame and chassis of automobiles by optimizing deposition parameters such as temperature, pH, electric current density of an electrolyte consisting of zinc sulfate hydrate, iron sulfate hydrate, ammonium sulfate and potassium chloride as well as the thickness of a coating layer.

BRIEF DESCRIPTION OF THE DRAWINGS

In FIG. 1, the steel sheets coated under 50 mA/cm$^2$ showed lower corrosion current and corrosion potential than those coated under 500 mA/cm$^2$ thus implying that the lower the current density the better the corrosion resistance.

In FIG. 2, the steel sheets coated under 50 mA/cm$^2$ showed high corrosion characteristics as a whole with a great fluctuation of noise resistance upon time passage and this phenomenon is ascribed to the responses of said steel sheets to the progress of corrosion that repeats the stagnant phase and locally activated phase. On the contrary, the steel sheets coated under 500 mA/cm$^2$ showed relatively low noise resistance and corrosion proceeded without much fluctuation upon time passage thus proving that steel sheets coated under lower current density have a better corrosion resistance.

In FIG. 3, the corrosion current decreased as the current density decreased and this result implies that corrosion resistance becomes better when the current density becomes lower with the optimal range of current density being 50–100 mA/cm$^2$.

In FIG. 4, the corrosion current decreased as the iron content decreased with the optimal range of iron content being from 2 to 4 wt. %. Here, the pH of the electrolyte was between 3 and 4 and the thickness of coated layer was 5–7 $\mu$m.

DETAILED DESCRIPTION OF THE PREFERRED EMBODIMENT

Figure 1:
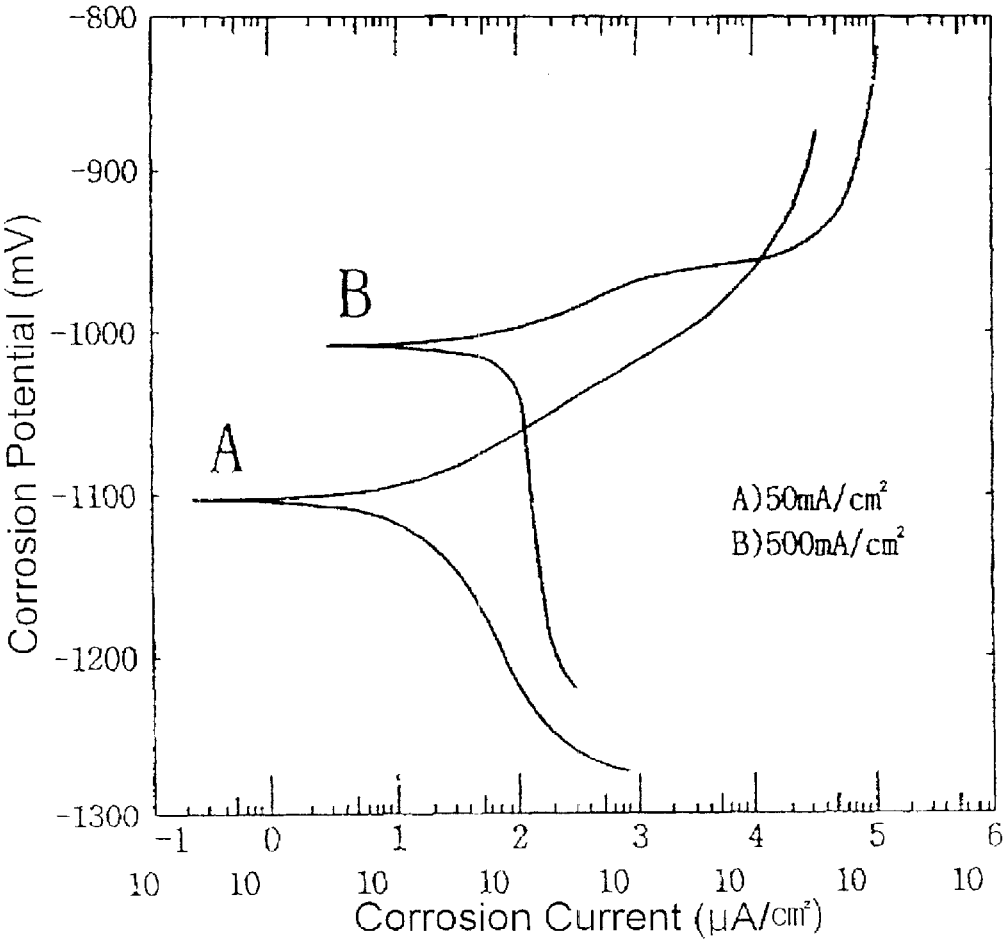
FIG. 1 is a graph that shows the corrosion characteristics of coated steel sheets manufactured under A) 50 mA/cm$^2$ and B) 500 mA/cm$^2$, respectively, according to the present invention, i.e., the relationship between the corrosion current and the corrosion potential of said steel sheet.
Figure 2:
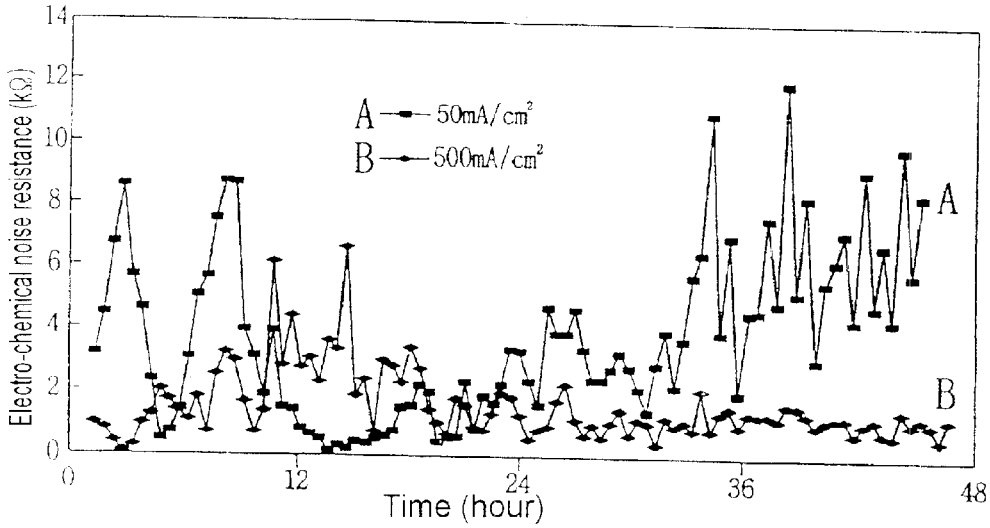
FIG. 2 is a graph that shows the corrosion characteristics of coated steel sheets manufactured under A) 50 mA/cm$^2$ and B) 500 mA/cm$^2$, respectively, according to the present invention in terms of an electro-chemical noise resistance.
Figure 3:
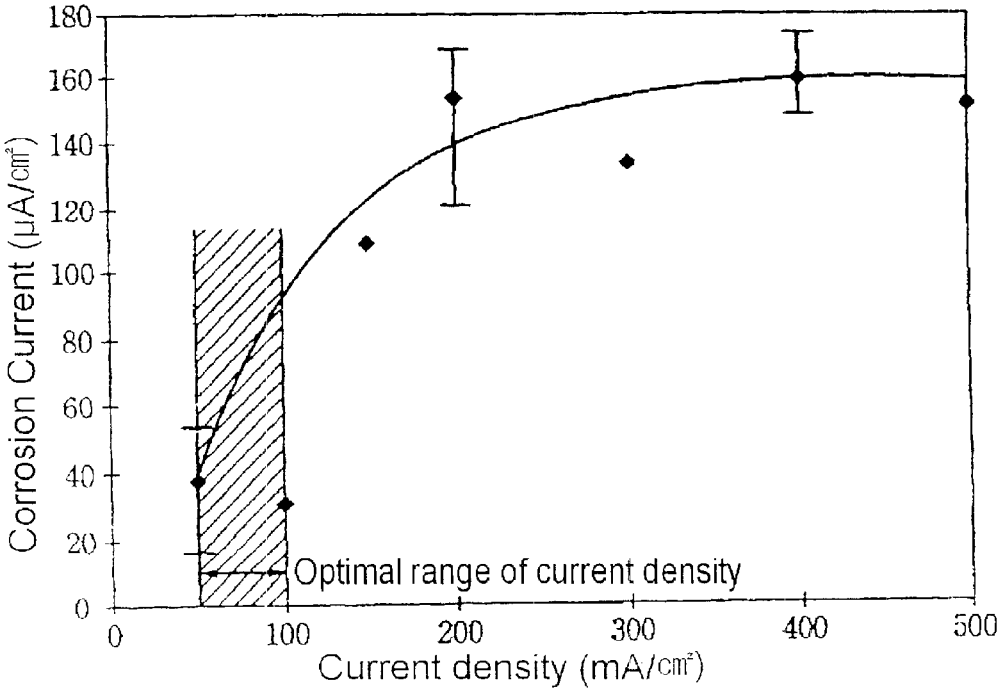
FIG. 3 is a graph that shows the change in corrosion current of coated steel sheets manufactured under A) 50 mA/cm$^2$ and B) 500 mA/cm$^2$, respectively, according to the present invention.
Figure 4:
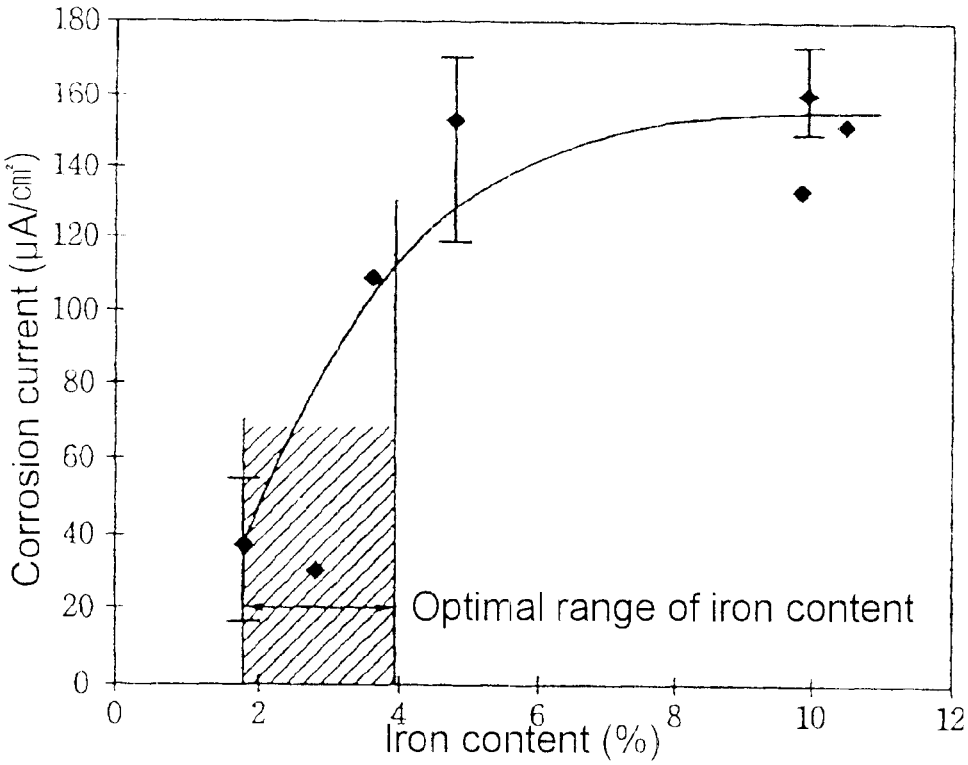
FIG. 4 is a graph that shows the change in corrosion current of coated steel sheets manufactured under A) 50 mA/cm$^2$ and B) 500 mA/cm$^2$, respectively, according to the amount of iron content (wt. %) in present invention.

The present invention aims at manufacturing steel sheets coated with Zn—Fe alloy having an improved productivity, an excellent corrosion resistance with a 5–7 $\mu$m thickness of coated layer containing 2–4 wt. % of iron produced under optimal coating conditions of temperature, pH, electric current density of an electrolyte consisting of zinc sulfate hydrate, iron sulfate hydrate, ammonium sulfate and potassium chloride, and subsequent production of a body frame and a chassis of an automobile with a maximized commercial value.

The present invention can be described in more detail hereunder.

The process of manufacturing steel sheets coated with zinc can be generalized into three major steps of pretreatment, main process and post-treatment.

First, during a pretreatment process, cold-rolled coils become unrolled and the end part of each coil is cut out and welded to a strip. The part is then placed into a processing line, passed through a tension leveller to acquire a proper tension, and the surfaces of steels are finally washed, subjected to a general rinse and rinsed with acid.

In the main process, said pretreated steel sheets are placed in a coating cell to be coated, and here the coating electrolyte is preferred to consist of 23–34 wt. % of $ZnSO_4.7H_2O$, 37–48 wt. % of $FeSO_4.7H_2O$, 21–32 wt. % of $(NH_4)_2SO_4$ and 1–8 wt. % of KCl kept at between 48 and 52° C. with the pH 3–4; in fact, the formation of texture is known to be much influenced by the pH value and also by the temperature of a given coating electrolyte. In addition, the optimal range of current density during electrodeposition of coating in the present invention is found to be 50–100 mA/cm$^2$, and each sheet will be provided with an excellent corrosion resistant property under this condition.

Finally, said steel sheets are forced to go through with the post-treatment process which consists of general washing, oiling, drying, surface examination after passing through a looper and are ultimately wrapped onto a reel.

TABLE 1

| Classification | | Previous Conditions | Conditions of Present Invention |
|---|---|---|---|
| Composition | $ZnSO_4.7H_2O$ | 2–9 | 23–34 |
| Of the | $FeSO_4.7H_2O$ | 87–95 | 37–48 |
| Electrolyte | $Na_2SO_4$ | 1–7 | None |
| (wt. %) | $(NH_4)_2SO_4$ | None | 21–32 |
| | KCl | None | 1–8 |
| pH of the Electrolyte | | 2.3 | 3–4 |
| Temperature of the Electrolyte (° C.) | | 38–42 | 48–52 |
| Current Density ($mA/cm^2$) | | 460 | 50–100 |
| Iron content in coated layer (wt. %) | | 15–25 | 2–4 |

The above Table 1. shows the comparison of conditions between a conventional method and a method by the present invention used in coating steels with Zn—Fe alloy. As shown in the above, the $Na_2SO_4$ was replaced by $(NH_4)_2SO_4$ and KCl in the present invention and this resulted in the increase in pH of the coating electrolyte to 3–4. The temperature of the electrolyte in the present invention was adjusted to be approximately 10° C. higher than that used in the conventional method while the current density and the amount of iron present in coated layer were both lowered down to one fourth or less and one sixth to one seventh of those in the conventional method, respectively, thus much reducing the amount of consumption of power and iron. Consequently, steels coated under the improved conditions as disclosed in the present invention show a superior anti-corrosion property and are thus able to contribute to manufactured steels coated with Zn—Fe alloy having an improved corrosion resistance.

What is claimed is:

1. A method of manufacturing steel sheets coated with a layer of Zn—Fe alloy with an excellent corrosion resistance comprising three major steps of a pre-treatment including a general rinse and an acid rinse, a main process of coating steel sheets in a cell and finally a post-treatment of washing, oiling and drying, wherein the thickness of the coated layer on produced steel sheets falls between 5–7 $\mu$m by using a coating electrolyte consisting of 23–34 wt. % of $ZnSO_4.7H_2O$, 37–48 wt % of $FeSO_4.7H_2O$, 21–32 wt. % of $(NH_4)_2SO_4$ and 1–8 wt. % of KCl kept at 48–52° C. with a pH of 3–4 under an electric current density of 50–100 $mA/cm^2$.

2. A method of manufacturing steel sheets coated with a layer of Zn—Fe alloy according to claim 1, wherein the iron content in the coated layer ranges from 2 to 4 wt. %.

* * * * *